US006205851B1

(12) United States Patent
Jogi

(10) Patent No.: US 6,205,851 B1
(45) Date of Patent: Mar. 27, 2001

(54) METHOD FOR DETERMINING DRILL COLLAR WHIRL IN A BOTTOM HOLE ASSEMBLY AND METHOD FOR DETERMINING BOREHOLE SIZE

(75) Inventor: Pushkar Nath Jogi, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/072,891

(22) Filed: May 5, 1998

(51) Int. Cl.[7] ..... E21B 44/00; E21B 47/00; G01V 1/40

(52) U.S. Cl. ..... 73/152.47; 73/152.43; 175/39

(58) Field of Search ..... 73/152.47, 152.43, 73/152.52, 152.03; 175/39–40

(56) References Cited

U.S. PATENT DOCUMENTS 4,715,451 * 12/1987 Bseisu et al. ..... 175/40
4,903,245 * 2/1990 Close et al. .
5,159,577 * 10/1992 Twist .
5,313,829 * 5/1994 Paslay et al. .
5,358,059 * 10/1994 Ho .
5,469,736 * 11/1995 Moake .
5,842,149 * 11/1998 Harrell et al. ..... 702/9
5,864,058 * 1/1999 Chen ..... 73/152.47

* cited by examiner

*Primary Examiner*—Hezron Williams
*Assistant Examiner*—David J. Wiggins
(74) *Attorney, Agent, or Firm*—Cantor Colburn LLP

(57) ABSTRACT

A method for determining the existence of a whirling condition during drilling of a borehole provides real time determination of destructive conditions of a bottom hole assembly during drilling. The method measures the acceleration of the bottom hole assembly to determine one or more acceleration values. Sensors also measured with rotation speed of the bottom hole assembly to determine at least one rotation of speed value. Based upon this information calculations are performed to determine a radius or diameter of rotation in the time domain which will indicate and identify the whirling condition within the bottom hole assembly. Types of whirl conditions identifiable are forward and backward whirl with and without slip. The method assumes forward whirl and backward whirl and creates a plot for each then overlaps the plot which provides an accurate representation of the condition of the bottom hole assembly while drilling. The method further provides rapid determination of whether further calculation is necessary by allowing the operator to locate the drill call at any given time and only if it is touching then completely balance the calculation to determine the whirling condition existing.

15 Claims, 8 Drawing Sheets

| | |
|---|---|
| 1-AXIS Oe<br>2-AXIS<br>MAGNETOMETER ASSEMBLY | 2-AXIS<br>ACCELEROMETER ASSEMBLY |

MAGNETOMETER/ACCELEROMETER ASSEMBLY

Flow Chart showing steps to plot whirl in real time:

Obtain measured values of Acceleration, RPM(N) and Depth

Assume Forward Whirl and compute radius r using eqn 5 Where $\omega = \frac{2\pi N}{60}$, Compute diameter of collar rotation $d_f = 2(r + r_2)$ Assume pure Backward Whirl. Compute $r_1$ using eqns 3, 6 & 7. Compute diameter of hole $d_b = 2r_1$ Compare $d_f$ and $d_b$ to obtain transition diameter $d_t$. It represents locations of transition from backward to forward whirl and vice versa Make a composite plot : The lower half representing Forward Whirl with diameter ranging from 0 to $d_t$ and the upper half representing Backward whirl with diameter ranging from $d_t$ to 0 along the y axis.

Plot Borehole diameter $D_b$ on both halves of composite plot : Data points between $d_t$ and $D_b$ represent locations with slip in either types of whirl on the composite plot. Data points between 0 to $D_b$ represent areas with forward whirl on the lower half of the plot while data points from 0 to $D_b$ on the upper part of the plot represent locations with excessive accelerations. Data along $D_b$ on upper half of the plot represents locations with pure backward whirl.

FIG. 8

METHOD FOR DETERMINING DRILL COLLAR WHIRL IN A BOTTOM HOLE ASSEMBLY AND METHOD FOR DETERMINING BOREHOLE SIZE

BACKGROUND OF THE INVENTION

1. Field of the Invention

The invention relates to control of drilling apparatus in well drilling. More particularly, the invention relates to a method for determining the location and attitude of a bottom hole assembly (BHA) and the diameter of the borehole at the location of the measurement in a BHA.

2. Prior Art

The displacement of a bottom hole assembly (or BHA) with respect to the borehole center at the location of the measurement sub in a BHA is useful for avoiding tool failure. Similarly, the knowledge of the size of the borehole is useful for 1) deviation control and 2) corrections to resistivity and neutron tools results. More specifically, drilling with a slightly bent drill collar can cause mild whirling to violent lateral vibrations. The cause of misalignment of the tools axially that might exacerbate whirling problems are bending or sag of a drill collar which may be due to (or caused by) an initial bend or curvature in the collar, collar sag from gravitational forces or from unbalanced tools or sub-sections of the bottom hole assembly. The bow of the tool caused by the bend in combination with rotation about the borehole centerline and its own center, can cause the collar to whirl in a complicated manner. Such whirl causes chaotic displacements, collar-borehole wall impacts and friction at the collar-wall interface and each of these can extend from inconsequential to damaging.

Whirling can be ultimately destructive when the rotation rate of the assembly equals the natural frequency of the bottom hole assembly in bending. Surface abrasion of collars and fatigue failures can also readily occur and are a direct result of whirling.

Surface abrasion is normally caused by forward synchronous whirl of a high amplitude and usually affects the same side of the drill collar which is continually in contact with the borehole wall. Clearly wear in the affected area is enhanced and can cause both unbalance problems and direct failure of the collar.

Another possible complex movement with destructive consequences, if left unchecked, is backward whirl. Backward whirl causes fatigue failures of the bottom hole assembly components by inducing high frequency stress cycles therein. Backward whirl is the whirling of a drill collar, without slipping along the borehole wall, with the center of the collar rotating in a direction opposite to the imposed direction of collar rotation. The frequency with which the collar center rotates about the borehole center is generally much higher than the rotation rate of the collar. Determining that the collar is undergoing such a condition is obviously a precursor to alleviating the problem. Unfortunately, the prior art provides no reliable method of so determining and the condition is therefore left unchecked. Information gatherable with the present invention regarding whether a collar is undergoing forward or backward whirl, with or without slip is invaluable for avoiding failures since adjustments could be made prior to failure. Therefore if one knows what these conditions are at any given time, or preferably continuously, adjustments can be made to increase drilling efficiency and reduce the chances of breakage. For example, information regarding conditions being experienced while drilling might indicate a change in the drilling procedure such as a faster or slower drill speed or a different mud consistency or composure. Where these adjustments are made in a timely manner, difficulties can be avoided whereas breakage or other tool failure might be experienced if the drilling personnel is not aware of the BHA condition downhole.

Information such as that identified above has been sought for a number of years as it is known to the oil industry that knowledge of downhole conditions are one of the ways to ensure successful drilling and ultimate production. For this reason, some methods have been developed to provide information at the surface so that decisions can be made. Information reaching the surface quickly enough to allow for real time correction is particularly desirable.

One prior art method is disclosed in U.S. Pat. No. 5,313,829 to Pasley et al which is directed to determining bottom hole assembly lateral bending vibrations associated with elongated drill strings. The method incorporates a mechanical model which converts lateral vibrations to longitudinal and torsional vibrations measurable at the surface. The model simulates the condition of BHA whirling, incorporates the effects of bending due to whirl forces, and determines the shape of the bottom hole assembly during a particular vibration mode.

Another prior art method for analyzing drillstring vibration is disclosed in U.S. Pat. No. 5,321,981 to Macpherson. In this method, it is recognized that torsional vibration of a drillstring during drilling will lead to frequency modulation (FM) of the signal from a vibratory source. Such vibratory sources include for example, the drill bit. The frequency modulation of the signal results, in the frequency domain, in sidebands around the detected excitation frequency.

The method disclosed in the Macpherson patent employs the sidebands to improve drillstring and drilling performance. More particularly, the sidebands are used to discriminate between downhole and surface vibrational sources caused by torsionally induced frequency modulation. The sidebands are also used to determine the rotary speed of bottom hole assembly components. These are determined as a function of the excitation frequency, the frequency of torsional oscillation and the modulation index. Based upon all of the information gatherable using this method, the parameters of the drillstring or the drilling operation can be altered to optimize either the drillstring performance or the drilling operation. Unfortunately, although the prior art is effective for the intended purpose, it does not cure all of the problems experienced in relation to whirl.

A related problem in drilling with respect to which information would be helpful is the fact that as a result of some of the complex rotation discussed above and other reasons, the borehole becomes enlarged. A large hole causes the drill bit to deviate from its intended path. In addition, neutron and resistivity tool measurements, for example, will provide falsely interpreted results based upon such measurements. The prior art has not attempted to provide information directed to help alleviate this occurrence.

While the foregoing methods are workable for their intended purposes, other methods having specific benefits are still sought.

SUMMARY OF THE INVENTION

The method of the present invention provides real time and continuous information regarding location of the drill collar with respect to the borehole while the drilling operation is ongoing; a continuous whirl plot showing the drill collar rotating either in a backward or forward whirl while the drilling operation is ongoing; information regarding location where the transition from backward to forward whirl and vice versa occurs and indicating further if the collar is slipping in backward or forward whirl; real time information regarding locations of possible concern of where failure could occurs that remedial action can be taken in a timely manner; and information regarding borehole size at the location of the sensor which can change the directional tendencies of the BHA as well as provide false interpretations of other measurement devices such as resistivity tools and neutron tools.

The significant informational capacity of the present invention as set forth above is realized by measuring (1) the root mean square (RMS) value of x-y acceleration employing preferably an x-y (orthogonal) accelerometer system; and (2) downhole tool rotation rate in revolutions per minute (RPM) preferably employing a magnetometer. The two measurement devices noted may be placed either inside a collar which then may be mounted near any collar of interest or in the blade or body of a full gauge stabilizer. Where the devices are placed in the body of the stabilizer, the preferred placement is in the axial center of the stabilizer to improve hole size detection or the sensors may be mounted in the blades and processed so that the "effective" measurement location is the center of the stabilizer.

Information gathered from the sensors employed herein is converted mathematically to provide specific continuous and accurate information regarding the location of the collar with respect to the borehole center and whether the collar is in backward or forward whirl. The parameters noted above are all collected in real time so that adjustments may be made (rpm, weight-on-bit, etc.) to reduce the possibility of failure and enhance the performance of the operation being undertaken.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIG. 8 is a flow chart illustrating exemplary steps of the invention.

DETAILED DESCRIPTION OF THE PREFERRED EMBODIMENTS

Figure 1:
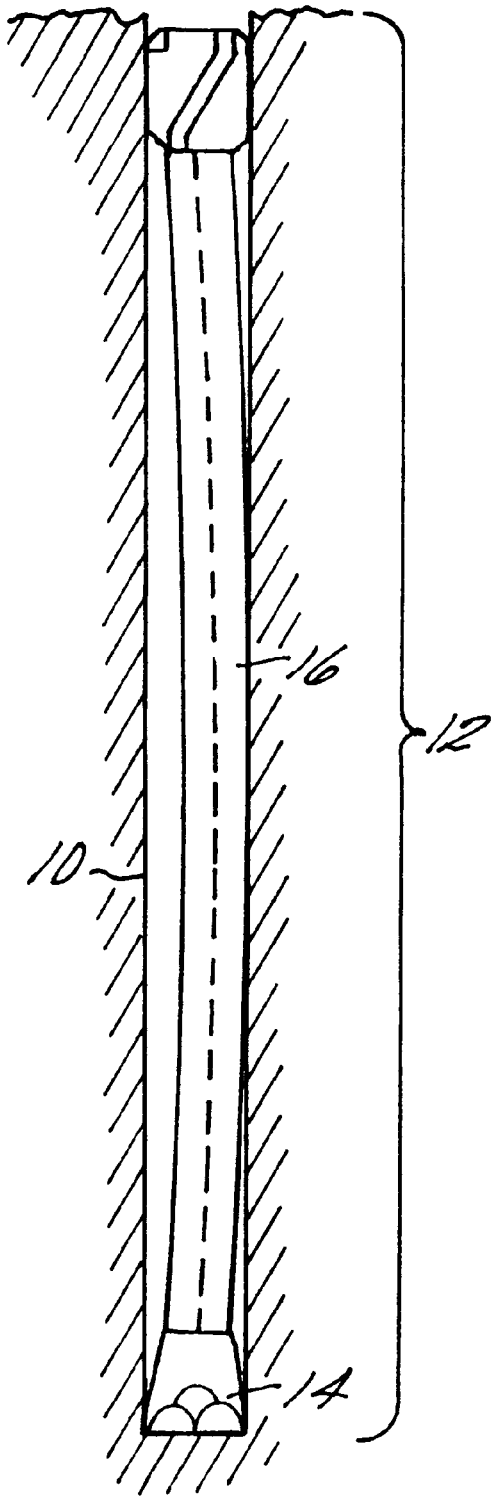
FIG. 1 is a schematic elevational view of a portion of a borehole with a portion of a bottom hole assembly illustrated in a displaced condition that produces whirl.

Referring to FIG. 1, one of ordinary skill in the art will recognize borehole 10 with a portion of a bottom hole assembly 12 (BHA) disposed therein comprising a drill bit 14, drill collar 16 and stabilizer 20. It will also be apparent to one of ordinary skill in this art that the illustration of FIG. 1 is not to scale but rather is simply illustrative. BHA'ss are typically 200 feet to 1000 feet long.

Figure 2B:
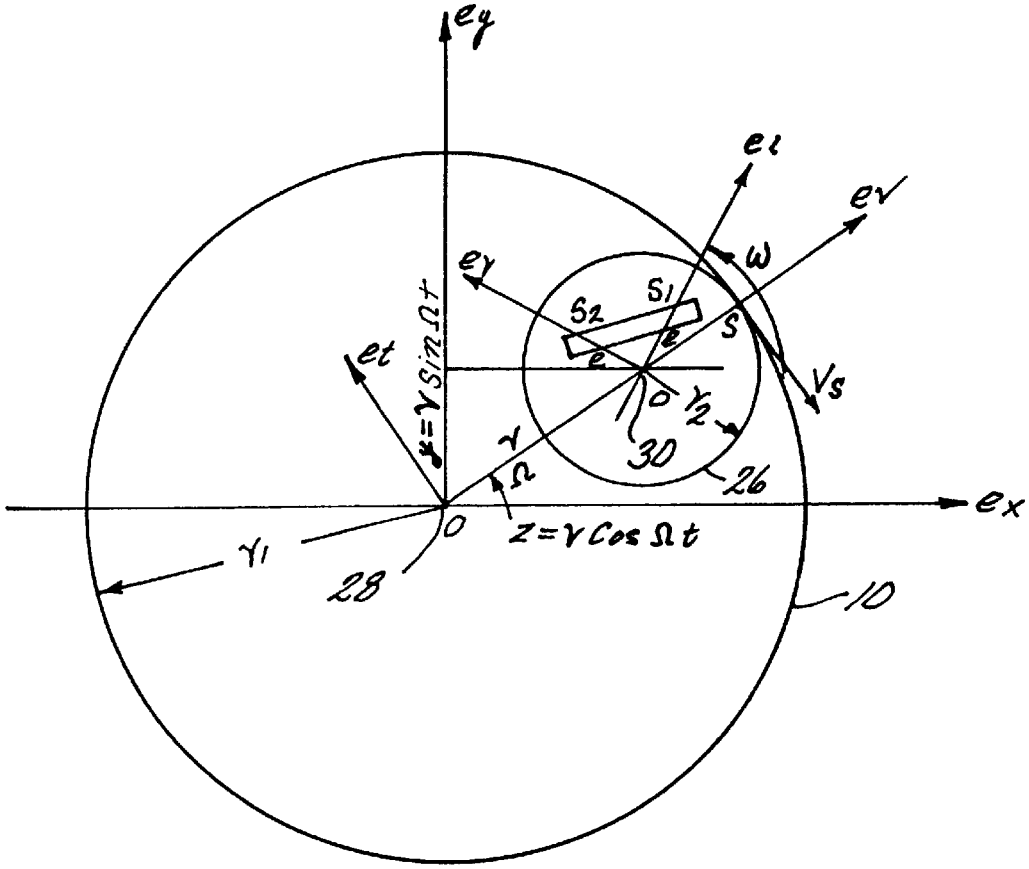
FIG. 2B is a schematic cross section illustration of the device in FIG. 2A placed within a borehole and with eccentricity noted.
Figure 2A:
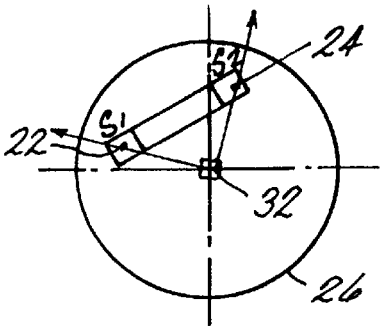
FIG. 2A schematically illustrates an x-y accelerometer and magnetometer system housed within a measurement tool which will be a part of the bottom hole assembly.

Referring to FIGS. 2A and 2B, an x-y accelerometer is schematically illustrated within a housing 26 in a portion of a BHA. The accelerometers are schematically illustrated in the position in the FIGURE only for clarity and mathematical purposes. Actually, the two accelerometers may preferably be on top of one another or orthogonally in the center of the tool. Accelerometer 22 senses acceleration in one direction and accelerometer 24 senses acceleration is an orthogonal direction to the first. The particular orthogonal orientation and placement of the accelerometers is selected to be able to compute acceleration at any location in the plane of the accelerometer (as well as simplify mathematical computation). In FIG. 2B, the FIG. 2A illustration has been illustrated in the borehole 10. Indicators ex and ey represent the axes of the global coordinate system fixed in space; $e_r$–$e_t$ is the radial-tangential coordinate system which rotates with the collar about the borehole center 28; $e_i$–$e_j$ is the axis system which rotates about center 30 of the collar 26. The accelerations $a_{s1}$ and $a_{s2}$ measured at the two sensors 22 and 24, and their RMS value $a_{ms}$ are given by:

$$a_{s1}=-[r\Omega^2\cos(\omega-\Omega)t+e\omega^2] \quad (1)$$

$$a_{s2}=r\Omega^2\sin(\omega-\Omega)t \quad (2)$$

$$a_{rms}=\sqrt{[r^2\Omega^4+e^2\omega^4+2er\omega^2\Omega^2\mathrm{COS}(\omega-\Omega)t]} \quad (3)$$

WhereΩ—Whirl rate

ω—Collar rotational rate r—Collar center displacement t—Time

The collar rotation rate ω can be determined from magnetometer measurements, the magnetometer assembly being illustrated schematically in FIG. 2A as box 32. While a single magnetometer coil is acceptable, two coils are preferably arranged as a 90° angle to one another. With a two magnetometer assembly, ω can be obtained by taking the time derivative of the phase angle between the x and y orthogonal magnetometer measurements $M_{gx}$ and $M_{gy}$:

$$\omega=\frac{\partial}{\partial t}\left[\tan^{-1}\left(\frac{M_{gx}}{M_{gy}}\right)\right] \quad (4)$$

With one magnetometer in the assembly, the RPM is obtained by the phase lag method using the Hilbert Transform. In the case of forward synchronous whirl where Ω=ω, equations (1–3) give $$a_{s1}=-(r+e)\omega^2$$

$$a_{s2}=0$$

$$a_{rms}=(r+e)\omega^2 \quad (5)$$

For backward whirl, where $r=r_1-r_2$, the backward whirl frequency $\Omega=\Omega_b$ is related to (ω as follows:

$$\Omega = \Omega_b = -\frac{r_2}{r_1 - r_2}\omega \quad (6)$$

$$w - \Omega = \frac{r_1}{r_1 - r_2}\omega \quad (7)$$

where $r_1$ and $r_2$ represent the radii of the borehole and the collar, respectively. For forward whirl with slip $0<\Omega<\omega$, while for backward whirl with slip $\Omega_b<\Omega<0$ In accordance with an important feature of this invention computing the whirl of the particular drill collar 26 that is the focus of the inquiry, is effected by:

(1) Determining the collar rotational rate by employing the equation identified as (4) which, of course, employs information received from the magnetometer assembly as discussed. The answer to this equation is then employed in equation (5);

(2) Assume the collar is in forward synchronous whirl and compute the diameter of rotation (i.e. the largest diameter created by a point on the outside of a bend and rotated through a full turn of the drill string). The diameter of rotation of the collar is represented by:

$$D_f=(r+r_2)2$$

This is computable from the known values of acceleration $a_{rms}$ and RPM from equations (4) and (5). If at any location, the magnitude of $D_f$ is less than hole diameter ($2r_1$), it is then known that the collar is rotating with its center displaced from the borehole center by r, but without touching the borehole. Thus, it is proven the collar is rotating in forward synchronous whirl.

Figure 5:
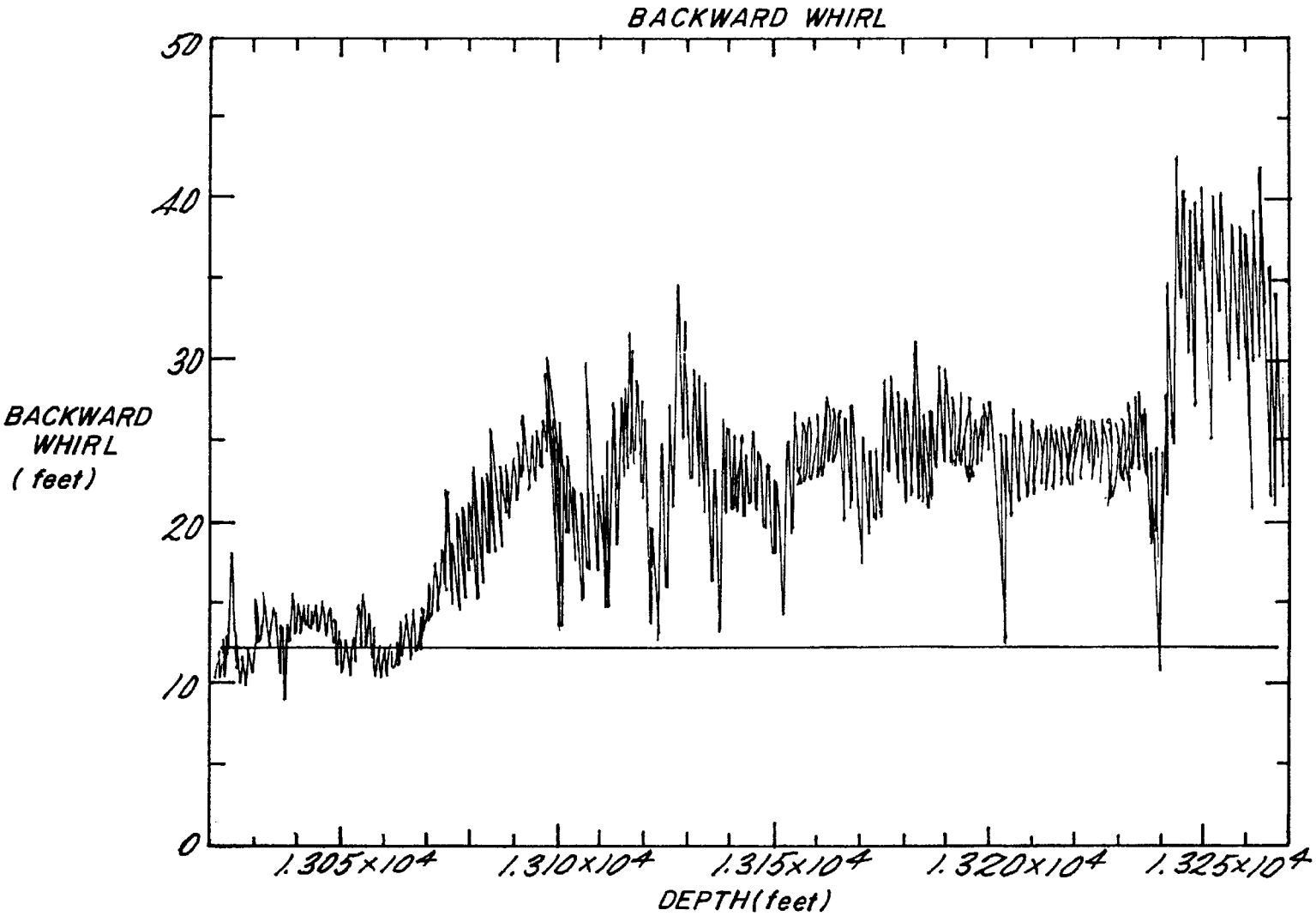
FIG. 5 is a graphic representation of computed location of top of collar with respect to borehole center using backward whirl formulation, plotting backward whirl against depth.

The next step, step (3) is to assume that the collar is in backward whirl and employ equations identified as (3), (6) and (7) to determine the radius $r_1$ for known values of acceleration $a_{rms}$, collar radius $r_2$ and collar RPM. If the collar is rotating in pure backward whirl, (see FIG. 5) the computed radius $r_1$ should match the actual hole radius at that location.

Figure 3:
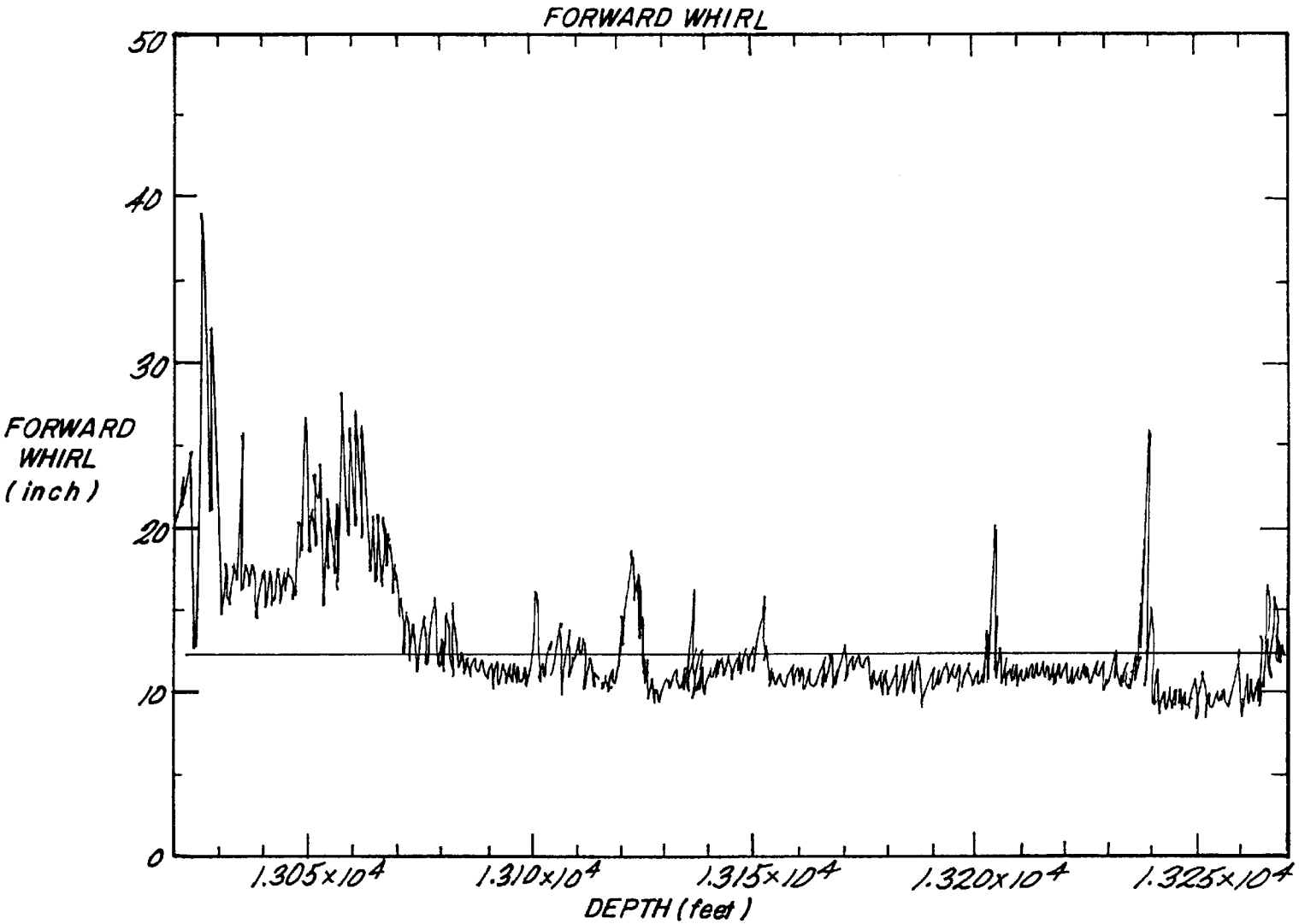
FIG. 3 is a graphic representation of computed location of top of collar with respect to borehole using forward whirl formulation, plotting forward whirl against depth.
Figure 4B:
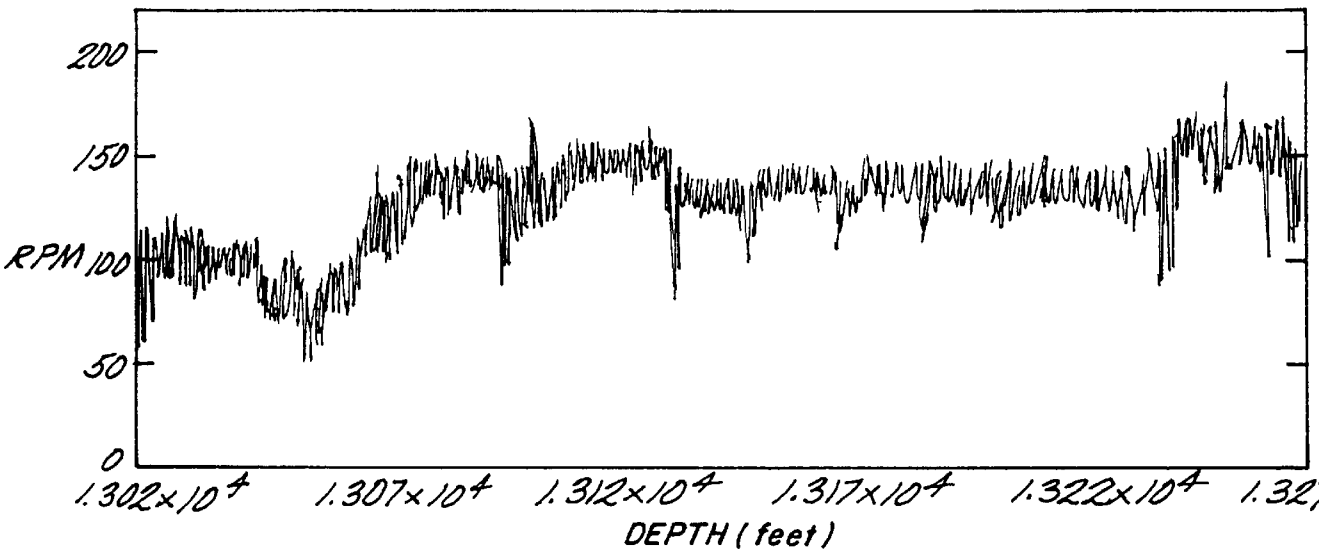
FIG. 4B is a graphic representation of RPM of the tool versus depth.
Figure 4A:
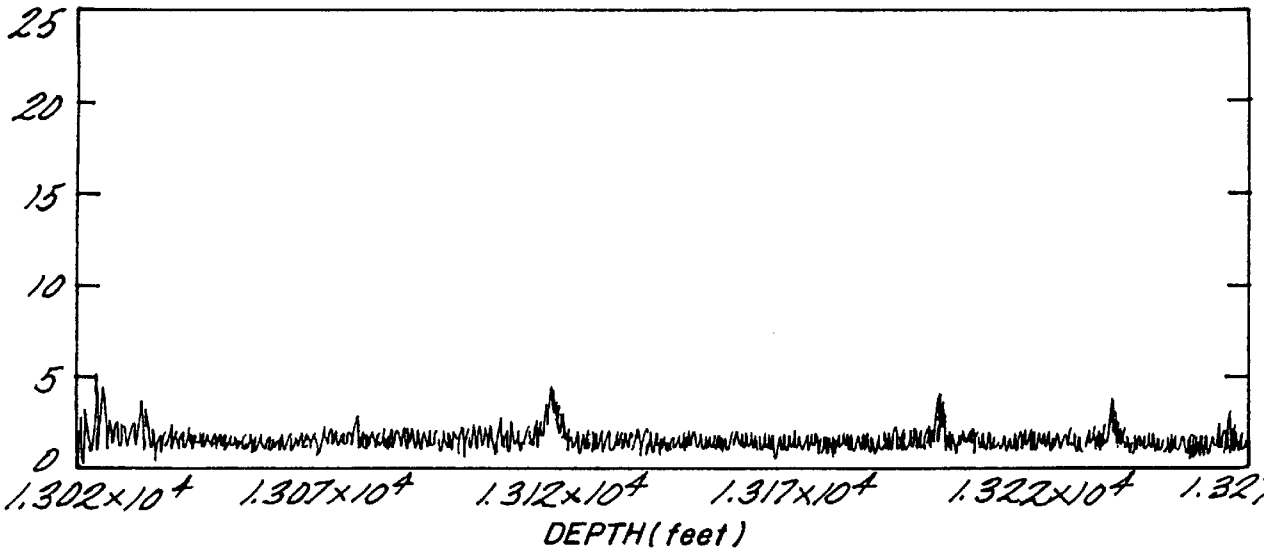
FIG. 4A is a graphic representation of acceleration versus depth.

Step (4) is to compare the radii (or diameters) of rotation which were determined in steps 2 and 3. The comparison allows for a continuous determination of the whirl condition of the collar in each location in which measurements are taken. By comparing the graphic representation of FIGS. 3 and 5 of this disclosure, one of skill in the art will appreciate locations where forward whirl is occurring. In these locations, the calculated diameter of the borehole from equation (5) will be artificially smaller or equal to actual borehole size. The calculated borehole diameter based upon equations (3), (6) and (7) on the assumption of backward whirl, however, will be artificially large at those locations. Similarly, in locations of pure backward whirl or in areas where there are measured acceleration values which exceed the normal, the computed diameter of the hole will be equal to or less than less than the actual diameter of the borehole. Measured acceleration values that are excessively high, attributed to impacts on the borehole wall, will exhibit lower computed values. Based upon a forward whirl assumption, the numbers will, as expected, be larger than the actual borehole dimensions.

In order to determine the location where transition from forward whirl to backward whirl and vice versa takes place and locations where slip is experienced, information gathered and computed from steps 2 and 3 is employed. More specifically, the plots created from the data sets in steps 2 and 3 are combined in step 5. Step 5 superimposes the plots from steps 2 and 3. Upon superimposition, it will be appreciated that the plots based on forward whirl and backward whirl assumptions cross each other several times to provide a line of symmetry reference at a particular indicated hole diameter. The indicated diameter is larger than the actual borehole diameter. The step provides information regarding the locations where transition takes place. The locations lying between the transition diameter and the actual borehole diameter represent the locations of slip corresponding to forward and backward whirl.

Figure 6:
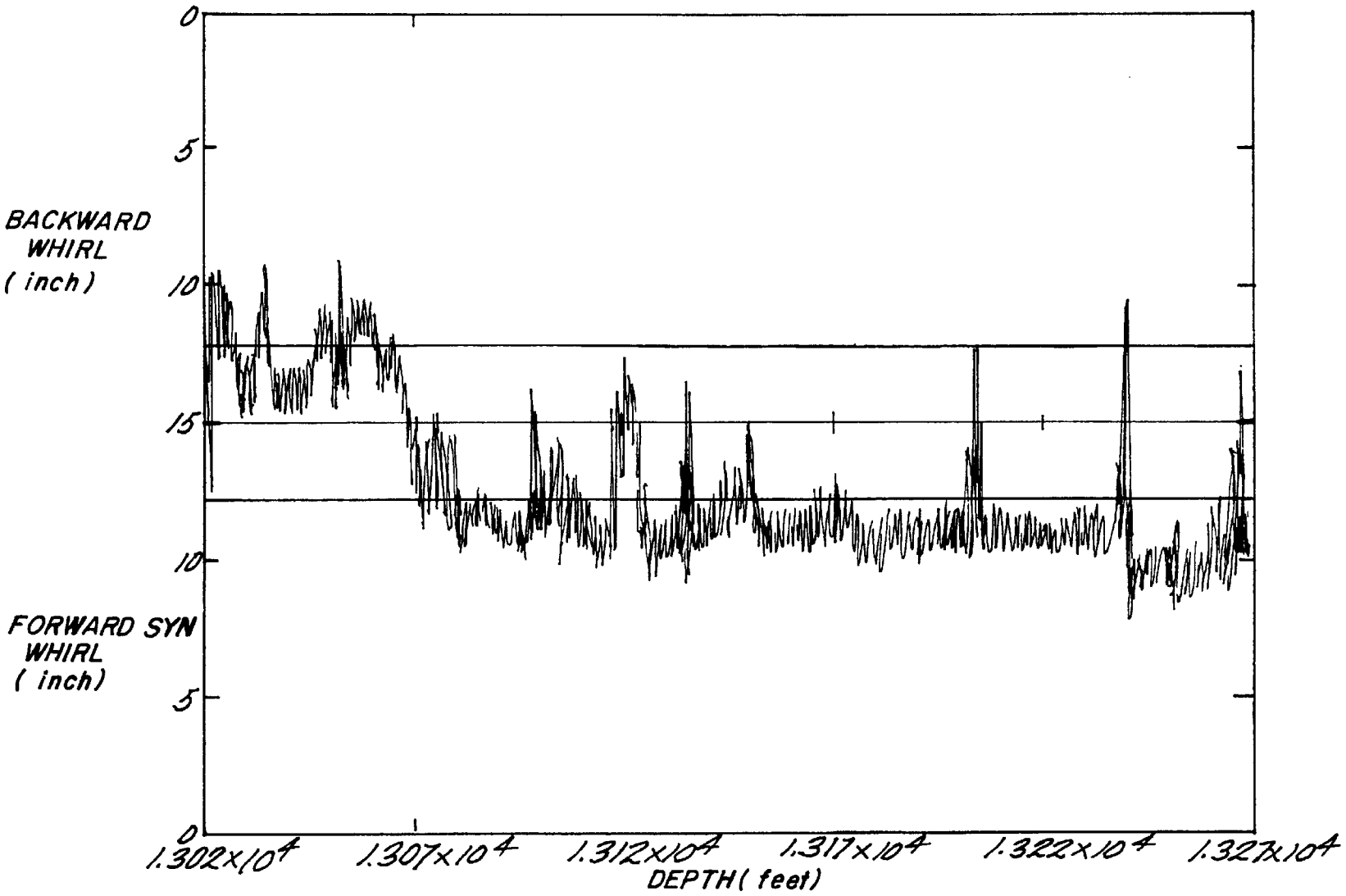
FIG. 6 is a composite graphic representation of backward whirl and forward synchronous whirl plotted against depth to provide a continuous whirl curve.

In step 6 the plots are superimposed differently from step 5 to provide a continuous whirl curve. The difference in the super position is that the backward whirl curve has been plotted upside down so that the plots (illustrated in FIG. 6) intersect at the transition hole diameter of 15 inches, in this example. An ascending diameter from 0 to transition diameter (at 15), determined in step 5, represents the forward whirl part of the curve. The descending diameter from transition diameter to 0 is the backward whirl part of the curve. It will be noted that the actual hole diameter is plotted as a reference on either side of the transition line. Using this plot, condition of movement of the BHA is easily determinable. Referring to the lower side of the plot, from zero to hole diameter, the figure indicates regions of: forward whirl without slip; and from hole diameter to transition diameter, the region of forward whirl with slip. Similarly, on the upper part of the plot, the region of transition diameter of 15 inches to borehole diameter of 12.25 inches represents the location of backward whirl with slip. Data along the borehole diameter represents pure backward whirl and the data between zero and borehole diameter represents and area of concern where measured accelerations are excessive. By following the curve one can determine when and where conditions dangerous to the BHA are encountered or will occur.

Figure 7:
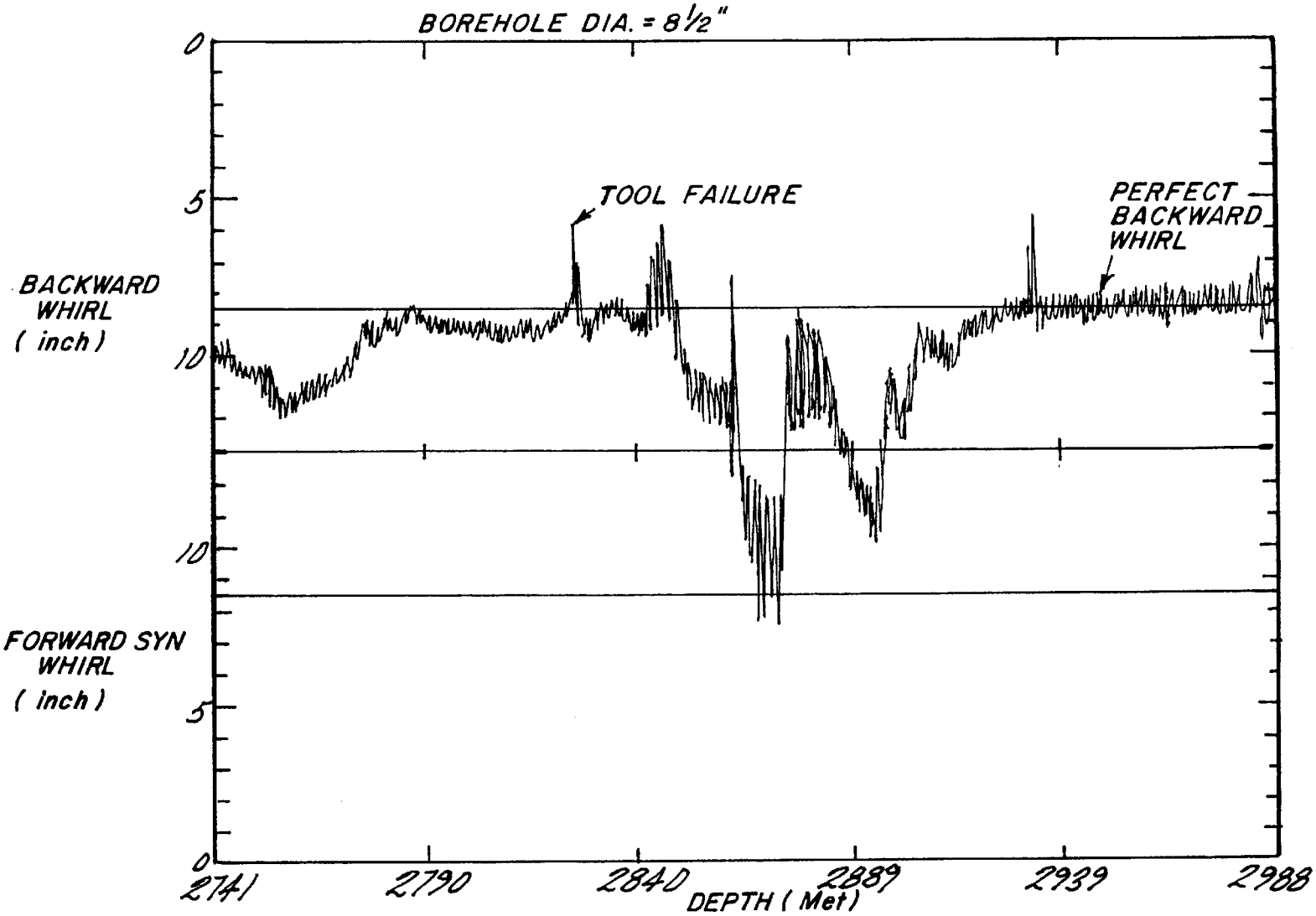
FIG. 7 is a graphic overlap representation as is FIG. 6 but with a different data set calculated to show locations of possible tool failure.

Referring to FIG. 7 a strong data peak in the backward whirl portion of the plot, i.e. smaller than borehole diameter region, indicates a potential tool failure condition because of higher than normal acceleration values. As noted above higher than normal acceleration values indicate violent activities such as borehole wall impacts, etc. These activities clearly, if uncorrected, could lead to tool failure.

With respect to computation of actual hole size during drilling; it will be understood by one of skill in the art that the collar will whirl along the borehole wall as the hole starts becoming overgauge from the originally intended gauged hole size. This is because with the overgauge hole the accelerometer, mounted preferably in the axial center of the tool, will experience acceleration it would not experience if the hole were properly gauged. The lack of acceleration in the gauged hole is explained by the fact that the accelerometer merely spins on its own axis and receives no acceleration change. When the hole becomes overgauged, however, whirl begins and the accelerometer experiences acceleration change. The amount of change in acceleration is proportional to the hole size change and whether the tool is in forward whirl or backward whirl with or without slip. Thus since these parameters can be determined from the above steps, the hole size can also be determined easily.

All of the steps of the method of the invention may be carried out continuously and automatically by a surface or downhole electronics package having been assembled to be capable of receiving and processing the information obtained from the sensors discussed hereinabove. The computed information may be fed either to a terminal for technician observation or to a controller that is programmed to automatically adjust drilling parameters such as speed, weight-on-bit, etc. to alleviate any condition that would cause a premature failure of the tool. Moreover a continuous borehole size chart is easily obtainable from the data as described.

With respect to operation of the automated system, a flow diagram is provided at FIG. 8 to graphically illustrate the steps taken and followed by the various elements of the invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for determining the existence of a whirling condition during the drilling of a borehole comprising:

measuring acceleration of a bottom hole assembly to determine at least one acceleration value;

measuring rotational speed of said bottom hole assembly to determine at least one rotational speed value;

calculating, based upon said at least one acceleration value and said at least one rotational speed value, the existence and identification of a whirl condition within said bottom hole assembly;

continuously determining one of computed borehole diameter and radius dimension with equations used for each of an assumed forward whirl condition and an assumed backward whirl condition over time with respect to said equations used for each of said assumed forward whirl condition and said assumed backward whirl condition;

plotting said dimensions over time with respect to said equations used for each of said assumed forward whirl condition and said assumed backward whirl condition; and determining areas of forward synchronous whirl, with and without slip, and backward whirl, with and without slip, over time from said plot.

2. A method for determining the existence of a whirling condition during the drilling of a borehole as claimed in claim 1 wherein said method further comprises optimizing the drilling of said borehole by adjusting drilling parameters based upon the calculated existence and identification of said whirl condition to alleviate said condition whereby drilling of said borehole is optimized.

3. A method for determining the existence of a whirling condition during the drilling of a borehole as claimed in claim 1 wherein said calculating further includes computing values that fit in the relation $0<\Omega<\omega$ for forward whirl and $\Omega_b<\Omega<0$ for backward whirl, where $\Omega$=collar whirl rate, $\Omega_b$=whirl rate for backward whirl, and $\omega$=rotational frequency.

4. A method for determining the existence of a whirling condition during drilling of a borehole as claimed in claim 3 wherein said calculating further includes determining bottom hole assembly forward whirl via a set of steps comprising:

determining a rotational rate of the bottom hole assembly by using a magnetometer with a magnitude and a phase angle output and then taking the time derivative of a phase angle of a ratio of magnetometer readings gathered by at least one magnetometer;

initially assuming that the bottom hole assembly is in forward whirl and computing the diameter of the bottom hole assembly to determine the accuracy of the assumption by computing the diameter of the borehole as a function of axial bottom hole assembly displacement added to bottom hole assembly radius; and confirming forward whirl where computed borehole diameter is less then an actual diameter of the borehole, but otherwise assuming that the bottom hole assembly is moving in backward whirl unless the computed borehole diameter equals the actual diameter of said borehole.

5. A method for determining the existence of a whirling condition during the drilling of a borehole as claimed in claim 1 wherein said measuring acceleration is carried out by providing at least one accelerometer associated with said bottom hole assembly.

6. A method for determining the existence of a whirling condition during drilling of a borehole as claimed in claim 5 wherein said at least one accelerometer is at least two accelerometers orthogonally positioned relative to one another.

7. A method for determining the existence of a whirling condition during the drilling of a borehole as claimed in claim 1 wherein said measuring rotational speed is carried out by at least one magnetometer associated with said bottom hole assembly.

8. A method for determining the existence of a whirling condition during drilling of a borehole as claimed in claim 7 wherein said at least one magnetometer is at least two magnetometers arranged orthogonally to one another.

9. A method for determining the existence of a whirling condition during the drilling of a borehole as claimed in claim 1 wherein said calculating includes comparing at least one radius of said borehole at at least one point in time, a rotational rate of the tool, a displacement of the tool axial center from the borehole axial center, and the tool whirl rate in an equation at at least a point in time when the radius of the borehole is measured.

10. A method for determining the existence of a whirling condition during drilling of a borehole as claimed in claim 9 wherein rotational rate is determined by reading at least one magnetometer in said tool.

11. A method for determining the existence of a whirling condition during drilling of a borehole as claimed in claim 9 wherein said comparing the radius, a point in space and the rotational rate of the tool with known values of acceleration provides a magnitude of a calculated diameter for each point in space, whereby the condition of the tool where the calculated diameter is less than the actual diameter of the borehole, forward synchronous whirl is confirmed.

12. A method for determining the existence of a whirling condition during drilling of a borehole as claimed in claim 1 wherein said method further includes adjusting drilling parameters to control each of forward synchronous whirl, with and without slip and backward whirl, with and without slip.

13. A method for determining the existence of a whirling condition during the drilling of a borehole, comprising:

determining the rotational rate of a tool in operation in a borehole;

assuming the tool is in forward whirl, identifying in graphic representations locations where possible tool failure is likely, said locations being locations of transition from forward to backward and backward to forward whirl, modifying at least one parameter of drilling to prevent said failure, and comparing measurement values and determinations for the radius of the borehole, the point in space, and the tool rotational rate in an equation to verify the forward whirl assumption;

assuming the tool is in backward whirl, identifying in graphic representations locations where possible tool failure is likely, said locations being locations of transition from forward to backward and backward to forward whirl, modifying at least one parameter of drilling to prevent said failure, and comparing the whirl rate, the tool rotational rate, the point in space, measurement values and determinations for the radius of the borehole, and time in an equation to verify the backward whirl assumption; and superimposing graphic representations of radii plotted over time to provide a continuous whirl curve whereby the existence of a forward or backward whirling condition of the tool in the borehole is determined.

14. A method for determining the existence of a whirling condition during the drilling of a borehole comprising:

measuring acceleration of a bottom hole assembly to determine at least one acceleration value;

measuring rotational speed of said bottom hole assembly to determine at least one rotational speed value; and calculating, based upon said at least one acceleration value and said at least one rotational speed value, a radius of rotation in the time domain to determine the existence and identification of a whirl condition within said bottom hole assembly, said calculating comprising, continuously determining one of computed borehole diameter and radius dimensions with equations for each of an assumed forward whirl condition and an assumed backward whirl condition over time, plotting said dimensions over time, and determining areas of forward synchronous whirl, with and without slip, and backward whirl, with and without slip, over time from said plot.

15. A method for determining the existence of a whirling condition during the drilling of a borehole as claimed in claim 14 wherein said method further includes adjusting drilling parameters to control each of forward synchronous whirl, with and without slip, and backward whirl, with and without slip.

* * * * *

UNITED STATES PATENT AND TRADEMARK OFFICE

CERTIFICATE OF CORRECTION

PATENT NO. : 6,205,851 B1
DATED : March 27, 2001
INVENTOR(S) : Pushkar Nath Jogi It is certified that error appears in the above-identified patent and that said Letters Patent is hereby corrected as shown below:

Column 4,
Line 13, after "illustrative." delete "BHA'ss" and insert therefor -- BHA's --
Line 28, after "Indicators" delete "ex and ey" and insert therefor -- $e_x$ and $e_y$ --

Column 7,
Line 64, after "of" delete "axial" and insert therefor -- radial --

Signed and Sealed this

Twenty-second Day of March, 2005

JON W. DUDAS
*Director of the United States Patent and Trademark Office*